United States Patent [19]

O'Shea

[11] 4,172,216

[45] Oct. 23, 1979

[54] PRESSURE SENSITIVE SWITCH

[75] Inventor: Martin W. O'Shea, Manchaug, Mass.

[73] Assignee: Sprague Electric Company, North Adams, Mass.

[21] Appl. No.: 907,532

[22] Filed: May 19, 1978

[51] Int. Cl.[2] ..... H01H 9/02

[52] U.S. Cl. ..... 200/85 R; 200/86 R; 200/264; 340/666; 338/114

[58] Field of Search ..... 340/666, 667; 338/99-102, 114; 200/85 R, 85 A, 86 R, 86.5, 159 B, 264, 153 C

[56] References Cited

U.S. PATENT DOCUMENTS

| | | | |
|---|---|---|---|
| Re. 28,754 | 3/1976 | Cook et al. | 340/666 |
| 2,260,715 | 10/1941 | Ketchem | 200/85 R |
| 2,818,477 | 12/1957 | Gollhofer | 200/85 R |
| 3,487,451 | 12/1969 | Fontaine | 303/19 |
| 3,715,541 | 2/1973 | Koenig | 200/86 R |
| 3,830,991 | 8/1974 | Durocher | 200/86 R |
| 3,879,586 | 4/1975 | Durocher | 200/264 |
| 3,959,610 | 5/1976 | Finnegan | 200/264 |
| 3,960,044 | 6/1976 | Nagai et al. | 338/114 |

*Primary Examiner*—Gerald P. Tolin
*Attorney, Agent, or Firm*—Connolly and Hutz

[57] ABSTRACT

A resilient insulative layer of a plastic foam material is sandwiched between a dimpled carbon powder loaded plastic sheet and a resilient carbon powder loaded plastic foam pad. The dimples extend part way through holes provided therefor in the insulative layer. This sandwich assembly being placed under a bed mattress serves as a mattress-switch indicating electrically by contact between the sheet and the pad the presence of an occupant in the bed or his absence by lack of such contact. The characteristic time of the pad material for returning to its original shape is substantially longer than the corresponding return time of the insulative layer. Reliable operation is obtained for a wide range of occupant weights regardless of the weight(s) of the previous occupants.

6 Claims, 2 Drawing Figures

PRESSURE SENSITIVE SWITCH

BACKGROUND OF THE INVENTION

The present invention relates to a pressure sensitive switch, and more particularly to a mattress-switch for use in a bed egress alarm system. Such systems are typically employed in hospitals to continuously monitor the presence of a patient in a bed and to alert the hospital staff when a patient departs from the bed. A pressure-sensitive switch is typically inserted under the mattress, preferably closing an electrical alarm circuit under the weight of the patient on the mattress and opening the circuit to actuate the alarm when the patient departs. It is preferred that the switch be designed to open, rather than to close, upon departure of a person from the mattress, so that the more likely fail-open condition will always be called to the attention of the staff.

Pressure switches of the prior art, that are suitable for such use, employ a pair of metal strips, plates, sheets or wire mesh screening, the two metal members being separated by one or more insulative members such that physical distortion or compression of the assembly causes contact between the two metal pieces.

The pressure necessary to close such switches and/or the pressure at which the switch opens after having been pressed closed, tends to change with long periods of use and the degree of such sensitivity changes is a function of the loads to which it has been exposed. Such changes in sensitivity are most prominently due to the metal members taking a permanent set while being distorted or compressed.

It is an object of the present invention to overcome the shortcomings of such prior art switches.

It is a further object of this invention to provide a mattress-switch for use in a bed egress alarm system that is reliably operable for alternately detecting the presence in and absence from the bed of persons of widely different weights.

SUMMARY OF THE INVENTION

A pressure sensitive switch has a resilient compressible insulative layer sandwiched between a conductive and preferably incompressible sheet and a resilient compressible conductive pad. The conductive sheet has a plurality of regions that are raised with respect to one sheet surface, which surface faces the insulative layer. This layer has through-holes which are registered with the raised sheet portions and the raised portions extend only part way through the holes. A pair of lead wires is connected at one end thereof to the sheet and the pad, respectively.

The characteristic time for the material of the resilient pad to return to essentially its original shape, after relief from compression, is substantially greater than that of the resilient insulative layer. This feature compensates for any small amount of permanent set experienced by the insulative layer after relief from compression, so that the switch becomes reliably open circuited after each instance of removing the switch compressing forces no matter what the history has been of switch compression forces, e.g. light and then heavy, heavy and then light, etc. Thus the switch of this invention when used in the aforementioned bed egress alarm system, is capable of reliable opening and sounding the alarm upon the departure of a person of any weight from the bed, and is capable of reliable closing and quieting the alarm when a lighter person than the previous occupant enters the bed.

The resilient conductive pad is preferably made from a carbon powder loaded plastic foam while the resilient insulative layer is preferably made of a plastic foam. Plastic foam materials are highly compressible. Most importantly, the resilient plastic foams typically do not take a substantial permanent set (less than 20%) after long periods of distortion or compression.

The condcutive sheet and the raised portions thereof are preferably rendered conductive by also containing carbon so that the two switch contact elements are of a noncorrodible character. However, other materials for the sheet may be used such as an embossed metal sheet, or a dimpled plastic sheet having been clad or metallized with a metal such as copper or aluminum.

DESCRIPTION OF THE PREFERRED EMBODIMENT

Figure 1:
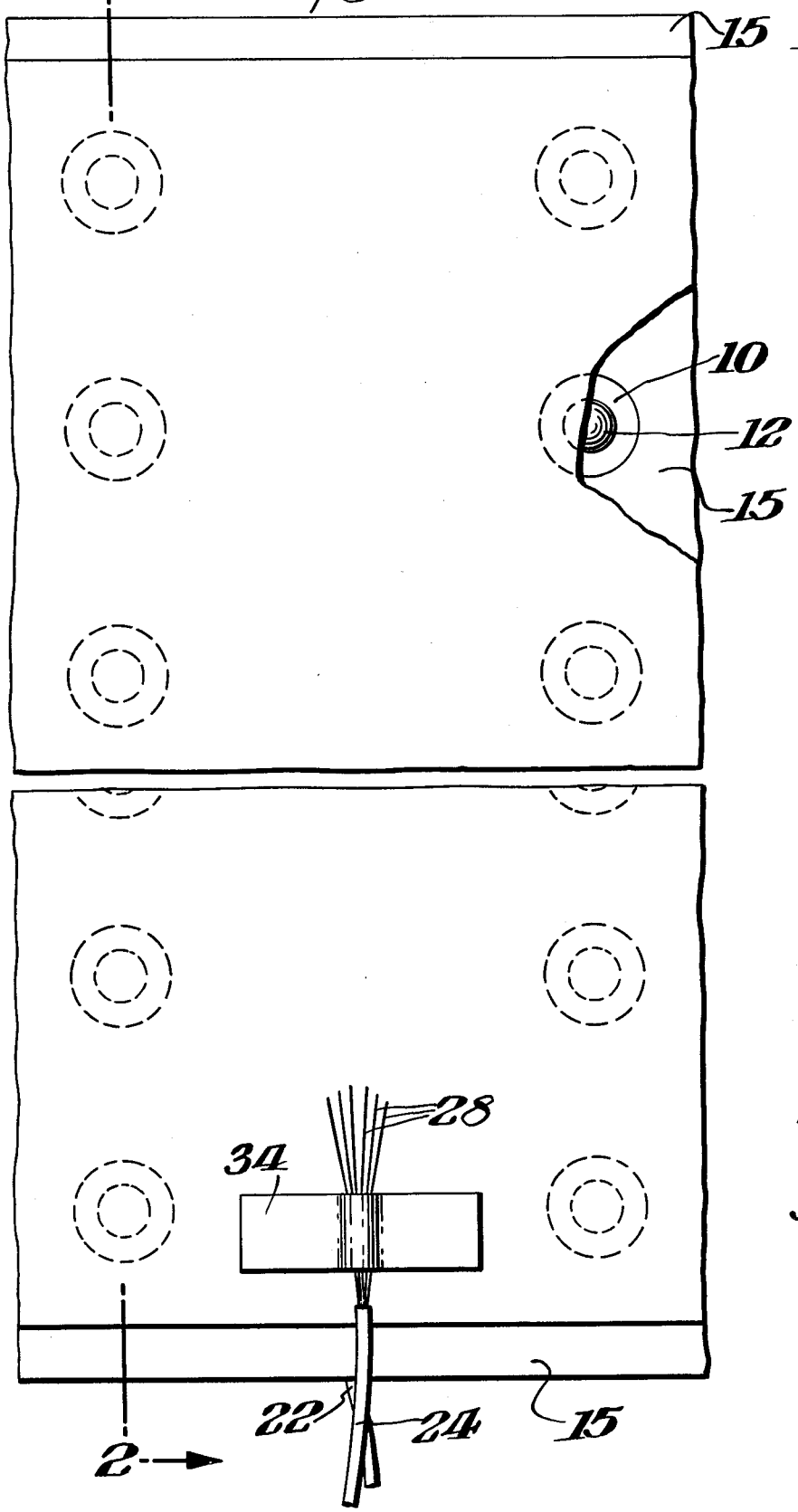
FIG. 1 shows in top view a portion of a mattress-switch of this invention.
Figure 2:
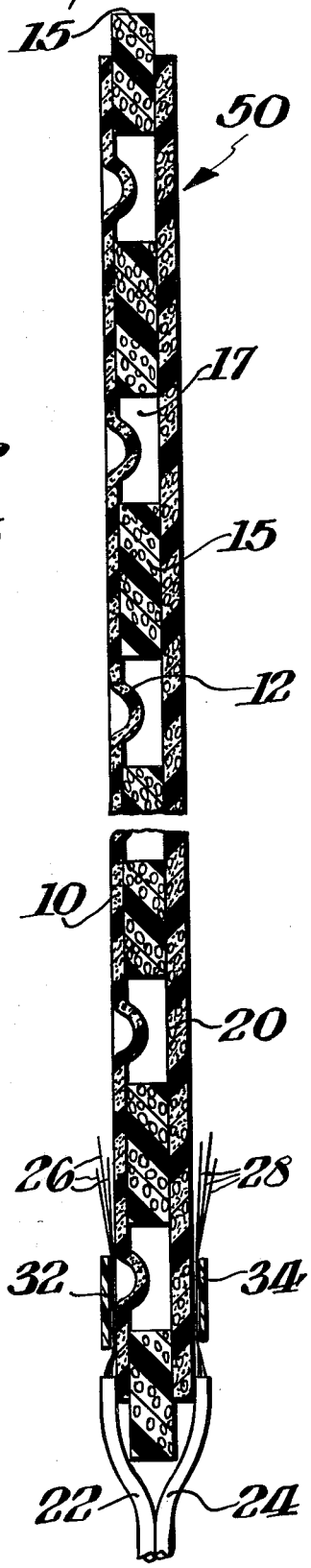
FIG. 2 shows in side sectional view, taken in plane 2—2, the portion of the mattress-switch shown in FIG. 1.

With reference to FIGS. 1 and 2, an electrically conductive sheet 10 being essentially incompressible has a plurality of dimples 12 embossed or raised therein, which dimples are spaced from each other and are arranged in a rectangular array covering a major surface area of the sheet 10. Sheet 10 is made of a carbon powder loaded thermoplastic having a thickness of 0.030 inch (0.76 mm). The dimples 12 are formed by a standard thermo-vacuum-forming process or alternatively may be formed by pressing the sheet 10 between two heated mating metal dies.

A resilient, compressible and electrically insulative layer 15 has a plurality of cylindrical holes 17 therethrough that are spaced from each other and are arranged in a rectangular array. Layer 15 is made of a plastic foam or sponge, such as foamed polyurethane which is commonly used as a protective material for packing delicate parts for shipping. This material has the property that after being compressed for long periods of time, even days or weeks, it is capable of returning rapidly to substantially its original shape, namely in less than a second. Such a product is designated P-1232 by the Firestone Foam Products Co., of East Providence, R.I.

The array of holes 17 have a corresponding spacing with the array of dimples 12 and the diameter of the holes 17 is about 0.75 inch (19 mm) while the diameter of the dimples 12 is 0.375 inch (9.5 mm).

The thickness of the insulative layer 15 is 0.25 inch (6.4 mm) while the height of the dimples is 0.125 inch (3.2 mm). The insulative layer is placed over the face of sheet 10 wherein the dimples 12 are convex so that each of the dimples 12 are registration. within one of the holes 17. An adhesive compound (not shown) is applied to a few small regions at the interface between the sheet 10 and the layer 15 in order to preserve the above noted registered.

A resilient compressible electrically conductive pad 20 is made of a carbon loaded plastic foam, having a thickness of 0.125 inch (3.2 mm). Such a foamed polyurethane material is made by Minnesota Mining Company, St. Paul, Minn., and identified as VELOSTAT-FOAM 1901. The conductive pad 20 is placed over the insulative layer 15 so as to sandwich layer 15 between the two conductive elements 10 and 20.

A pair of insulated lead wires 22 and 24 contain stranded copper conductors 26 and 28, respectively. The splayed bare ends of conductor 26 are held in electrical contact with the sheet 10 by means of a strip of adhesive tape 32 and similarly the splayed bare ends of conductor 28 are held in electrical contact with the conductive pad 20 by means of a strip of adhesive tape 34.

The above described assembly 50 including sheet 10, layer 15 and pad 20 are preferably contained in a protective plastic envelope (not shown), there being a hole at an edge of the envelope through which the lead wires 22 and 24 are brought out. The sheet 10 and pad 20 each have a length (vertically as seen in the Figures) of 24 inches (61 cm) and a width of 12 inches (30.5 cm). The insulative layer 15 is a little larger in each dimension so that it extends beyond the peripheries of the sheet 10 and pad 20.

This assembly 50 is designed for insertion under the mattress of a hospital bed, and located directly under the buttocks area of a patient lying on the bed. The long dimension of the assembly 50 extends laterally with respect to the major axis of the bed and the wires 22 and 24 extend laterally from under the mattress to a bed egress alarm circuit, such as that described by Cook and Horwitz in U.S. Pat. No. Re. 28,754 reissued Mar. 30, 1976. Thus, a patient lying in the bed compresses the switch assembly 50 causing one or more dimples 12 to contact the pad 20 and close the electrical circuit between the two lead wires 22 and 24 which places the alarm in the quiescent condition. When the patient departs the bed, the switch assembly is open circuited and the alarm sounds.

The mattress switch of this invention has been found capable of reliable operation for patients whose body weights may range from about 100 to 300 pounds (45 Kg to 136 Kg). Furthermore, reliable operation is achieved after many months of use, there being no significant change over such long periods of use in the sensitivity of the switch.

These features advantageously permit the use of one mattress switch for any one of a variety of patients having different body weights. This is attributable to the characteristic of the resilient conductive pad 20, whereby it returns essentially completely to its original shape after prolonged periods of severe compression (by the dimples). In other words it is essentially incapable of taking a permanent set due to compression. Mattress switches of the prior art that employ a distortable but incompressible metal sheet or metal wire screen for one or both switch contacts, are subject to changes in operating sensitivity due to the metal taking a permanent set after even short periods of use. Thus, such a switch may be satisfactory for use with one particular patient but, would tend to become inoperable (continuously open) thereafter for a patient having smaller body weight.

It may be observed that the metal screen of a prior art switch will take a particular set after use with a patient of any particular weight, thereby being self adjustable to the weight of that particular patient such that if the resilient insulative layer does not immediately return to its original thickness, the patient's departure from the bed is still reliably sensed by the opening of the switch. However, the switch of this invention offers this feature also, the resilient pad 20 being capable of taking a temporary set which slowly disappears in several minutes. More generally, it is characteristic of the switch of this invention, that the temporary compressional set taken by the pad 20 disappears substantially more slowly than the temporary compressional set taken by the insulative layer 15.

The mattress switch of the preferred embodiment provides the advantage that both of the switch contacts consist of a non-corrodible carbon, as opposed to metal contacts of the prior art that in time tend to oxidize or otherwise react to the atmosphere which may cause a non-conducting film to be grown over the contact surfaces leading to unreliable operation. Furthermore, the switch of this embodiment is made of low cost materials which are not subject to change in characteristics due to handling or due to operation in a high humidity environment.

What is claimed is:

1. A pressure sensitive switch comprising:

(a) an electrically conductive sheet having a plurality of regions being raised with respect to one surface of said sheet;

(b) a resilient compressible electrically insulative layer having a plurality of holes therethrough, said layer overlying said one surface, each of said raised regions being registered in one of said holes and extending less than all the way therethrough;

(c) a resilient compressible electrically conductive pad overlying said insulative layer on the opposite face thereof from said sheet, the characteristic time of the material of said pad for return to essentially its original shape, after relief from compression, being substantially greater than that of said layer; and (d) a pair of lead wires being connected at one end thereof to said sheet and to said pad, respectively.

2. The switch of claim 1 wherein said pad is a carbon powder loaded plastic foam.

3. The switch of claim 1 wherein said insulative layer is a plastic foam.

4. The switch of claim 3 wherein said plastic is polyurethane.

5. The switch of claim 1 wherein said conductive sheet is an essentially incompressible carbon-loaded plastic.

6. The switch of claim 5 wherein said plastic is a thermoplastic and said raised portions have the shape of dimples having been formed in said sheet by a standard thermo-vacuum-forming process.

* * * * *